US012710006B2

(12) United States Patent
Chaware et al.

(10) Patent No.: US 12,710,006 B2
(45) Date of Patent: Aug. 18, 2026

(54) SYSTEMS AND METHODS FOR CONTROLLING THE TEMPERATURE OF AN AFTERTREATMENT SYSTEM

(71) Applicant: Cummins Inc., Columbus, IN (US)

(72) Inventors: Mukund Shriniwas Chaware, Pune (IN); Muzammil Mohammed Gaffar Gadwal, Pune (IN); Shikha Gupta, Pune (IN); Chandrashekhar D Shete, Pune (IN); Ulhas Deutkar, Pune (IN); Milan Khushal Visaria, Pune (IN); Praveen Jadhav, Pune (IN)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 19/089,752

(22) Filed: Mar. 25, 2025

(65) Prior Publication Data

US 2025/0305432 A1 Oct. 2, 2025

(30) Foreign Application Priority Data

Mar. 26, 2024 (IN) ..... 202441023778

(51) Int. Cl.
*F01N 3/20* (2006.01)

(52) U.S. Cl.
CPC ..... *F01N 3/2046* (2013.01); *F01N 3/2053* (2013.01); *F01N 3/208* (2013.01)

(58) Field of Classification Search
CPC ..... F01N 3/2046; F01N 3/2053; F01N 3/208; F01N 2900/1602; F01N 3/2006; F01N 3/2066; Y02T 10/12
See application file for complete search history.

(56) References Cited

U.S. PATENT DOCUMENTS

| | | | | |
|---|---|---|---|---|
| 7,152,588 | B2 | 12/2006 | Corba | |
| 7,257,950 | B2 | 8/2007 | Iwaszkiewicz | |
| 8,001,778 | B2 | 8/2011 | Sun | |
| 8,752,364 | B2 * | 6/2014 | Guo | F02M 26/05 60/602 |
| 8,833,059 | B2 | 9/2014 | Keppeler | |
| 8,950,384 | B2 | 2/2015 | Vigild et al. | |
| 9,719,432 | B2 | 8/2017 | Nakada | |
| 11,319,888 | B2 | 5/2022 | Graichen et al. | |

(Continued)

FOREIGN PATENT DOCUMENTS

| | | |
|---|---|---|
| CN | 202900475 U | 4/2013 |
| CN | 110671213 B | 1/2020 |

(Continued)

OTHER PUBLICATIONS

Extended European Search Report on EP Appl. Ser. No. 25165625.2 Dated Jun. 5, 2025 (7 pages).

*Primary Examiner* — Hoang M Nguyen
(74) *Attorney, Agent, or Firm* — Foley & Lardner LLP

(57) ABSTRACT

Temperature control is provided. A method includes adjusting a first SCR intake position to a second SCR intake position to reduce a first difference between an SCR inlet temperature at the first SCR intake position and a target SCR inlet temperature, responsive to the determination of the first difference. The method includes adjusting a bypass valve position to reduce a second difference between the SCR inlet temperature at the second SCR intake position and the target SCR inlet temperature, responsive to determining the second difference.

20 Claims, 2 Drawing Sheets

(56) References Cited

U.S. PATENT DOCUMENTS

| | | | | |
|---|---|---|---|---|
| 2010/0083639 | A1* | 4/2010 | Mullins | F01N 3/0231 60/285 |
| 2011/0139136 | A1* | 6/2011 | Guo | F02M 26/05 123/676 |
| 2014/0007851 | A1 | 1/2014 | Vassallo et al. | |
| 2017/0145938 | A1* | 5/2017 | Kothandaraman | F02D 41/26 |
| 2022/0372926 | A1* | 11/2022 | Beinborn | F02D 41/024 |

FOREIGN PATENT DOCUMENTS

| | | | |
|---|---|---|---|
| CN | 108716433 | B | 9/2020 |
| CN | 117167134 | A | 12/2023 |
| JP | 2016-200113 | A | 12/2016 |

* cited by examiner

SYSTEMS AND METHODS FOR CONTROLLING THE TEMPERATURE OF AN AFTERTREATMENT SYSTEM

CROSS-REFERENCE TO RELATED APPLICATIONS

This application claims Paris Convention priority to Indian Provisional Application No. 20/2441023778, filed on Mar. 26, 2024. The entire content of the aforementioned application is incorporated herein by reference.

TECHNICAL FIELD

The present disclosure relates generally to exhaust devices and systems for use with internal combustion engines.

BACKGROUND

Air entering internal combustion engine can be compressed, before fuel is injected, by a compressor which compresses air flowing into the engine cylinder. In some embodiments, the internal combustion engine may be a diesel engine that is electronically controlled. When exhaust gas containing NOx exits the exhaust manifold, the exhaust gas flows into the aftertreatment system of the exhaust system which is used to treat the exhaust gas. Conventional exhaust systems include any of several different components to reduce the levels of certain exhaust emissions present in exhaust gas. Certain exhaust systems for diesel-powered internal combustion engines include a selective catalytic reduction (SCR) system to convert NOx (NO and $NO_2$ in some fraction) into nitrogen gas ($N_2$) and water vapor ($H_2O$) in the presence of ammonia ($NH_3$). Over time, deposits can form inhibiting the performance of the aftertreatment system such that it can be necessary to clean the exhaust system. Accordingly, a need exists for increasing the exhaust temperature in low temperature environments to clean (e.g., remove (desorb) adsorbed hydrocarbons, remove "coke," minimize deposits, particulate matter, etc.) the aftertreatment system.

SUMMARY

An implementation relates to a method of controlling an internal combustion engine and an aftertreatment system including a selective catalytic reduction (SCR) system. The method includes adjusting a first SCR intake position to a second SCR intake position to reduce a first difference between an SCR inlet temperature at the first SCR intake position and a target SCR inlet temperature, responsive to the determination of the first difference. The method includes adjusting a bypass valve position to reduce a second difference between the SCR inlet temperature at the second SCR intake position and the target SCR inlet temperature, responsive to determining the second difference.

In some embodiments, the method includes determining whether an intake manifold temperature is above a dew point temperature. The method can include adjusting the bypass valve position within a bypass valve opening limit responsive to determining that the intake manifold temperature is less than the dew point temperature. In some embodiments, the method includes determining a target deviation between the SCR inlet temperature and the target SCR inlet temperature. The method can include determining that the SCR inlet temperature is at the target SCR inlet temperature responsive to determining that a difference between the SCR inlet temperature and the target SCR inlet temperature is within the target deviation.

In some embodiments, determining the target deviation includes determining that the difference between the SCR inlet temperature and the target SCR inlet temperature is between 10 and 20 degrees Celsius. In some embodiments, the method includes adjusting the first SCR intake position based on a detection of an ambient temperature of the SCR system of between −30 to 45 degrees Celsius. In some embodiments, the method includes activating an SCR cleaning mode prior to comparing the SCR inlet temperature at the first SCR intake position to the target SCR inlet temperature. In some embodiments, adjusting the bypass valve position causes the target SCR inlet temperature to be between 380 to 420 degrees Celsius. In some embodiments, adjusting the first SCR intake position includes adjusting an intake throttle valve to an adjusted intake throttle valve position within an intake throttle valve limit. In some embodiments, adjusting the bypass valve position includes adjusting the bypass valve position within a bypass valve limit.

An implementation relates to a system for an engine, the system configured to communicate with a compressor. The system includes a conduit downstream of the compressor configured to deliver airflow to an intake manifold of the engine. The system includes a heat exchanger coupled to the conduit, the heat exchanger including a bypass conduit between an inlet of the heat exchanger and an outlet of the heat exchanger. The system includes a bypass valve coupled to the bypass conduit, the bypass valve configured to permit adjustment of airflow through the heat exchanger and the bypass conduit. The system includes an intake throttle valve coupled to the conduit downstream of the heat exchanger and coupled to the bypass conduit such that airflow from the bypass conduit is introduced to airflow exiting the outlet of the heat exchanger before entering the intake throttle valve, the intake throttle valve regulating airflow entering the engine. The system includes a selective catalytic reduction (SCR) system configured to receive exhaust gas produced by the engine through an SCR inlet. The system includes a controller. The controller is configured to receive sensor data including an SCR inlet temperature, generate control signals to decrease airflow through the intake throttle valve to reduce a difference between the SCR inlet temperature and a target SCR inlet temperature responsive to the SCR inlet temperature being less than the target SCR inlet temperature. The controller is configured to generate control signals to increase airflow through the bypass valve to reduce a difference between the SCR inlet temperature and the target SCR inlet temperature responsive to the SCR inlet temperature being greater than the target SCR inlet temperature.

In some embodiments, the sensor data includes an intake manifold temperature, and the controller is further configured to generate control signals to increase airflow through the bypass valve to increase the intake manifold temperature responsive to the intake manifold temperature being below a dew point temperature. In some embodiments, the controller is further configured to determine the dew point using ambient temperature and ambient pressure data, wherein the sensor data includes the ambient temperature and ambient pressure data from a temperature based ambient pressure (TBAP) sensor disposed upstream of the compressor.

In some embodiments, the controller is further configured to control the SCR system based on sensor data including at least one of engine rotation speed data, temperature variation data of airflow entering the SCR, pressure data of airflow entering the engine, temperature data of airflow entering the engine, pressure data of airflow exiting the compressor, or temperature data of airflow exiting the compressor. In some embodiments, the controller is configured to: compare a deviation between the SCR inlet temperature and the target SCR inlet temperature to a target deviation and generate the control signals to increase or decrease the airflow responsive to a comparison of the deviation to the target deviation. In some embodiments, the target deviation exceeds 10 degrees Celsius.

An implementation relates to a controller for an internal combustion engine and exhaust system including a selective catalytic reduction (SCR) system. The controller includes at least one processor coupled to at least one memory device storing instructions configured to, when executed by the at least one processor, cause the controller to execute instructions. The instructions includes instructions to receive, from one or more sensors, sensor data associated with engine operating conditions including selective catalytic reduction (SCR) inlet temperature. The instructions includes instructions to determine a first deviation based on a difference between the SCR inlet temperature and a target SCR inlet temperature. The instructions includes instructions to adjust an intake throttle valve position based on the first deviation to control airflow through the throttle valve responsive to the first deviation exceeding an allowable deviation. The instructions include instructions to determine a second deviation based on the adjusted intake throttle valve position and the difference between the SCR inlet temperature and the target SCR inlet temperature. The instructions include instructions to adjust a bypass valve position based on the second deviation to control airflow through the bypass valve responsive to a determination that the second deviation exceeds the allowable deviation.

In some embodiments, the instructions include instructions to obtain the target SCR inlet temperature from a look-up table using the sensor data associated with the engine operating conditions, wherein the target SCR inlet temperature satisfies a passive cleaning criterion of the SCR system. In some embodiments, the instructions include instructions to determine, based on an SCR conversion efficiency, the target SCR inlet temperature to maintain a target temperature zone for normal operation. In some embodiments, the instructions include instructions to detect an intake manifold temperature below a dew point temperature and generate a control signal to adjust the bypass valve position responsive to the detection, wherein an amount of the adjustment is based on a difference between the intake manifold temperature and the dew point. In some embodiments, the instructions include instructions to detect a condition of a cold start or a light load and determine the first deviation based on a difference between the SCR inlet temperature and a target SCR inlet temperature responsive to the detection of the condition.

An implementation relates to a method of controlling an internal combustion engine and an aftertreatment system including a selective catalytic reduction (SCR) system. The method includes comparing a SCR inlet temperature sensor at an SCR intake position to a target SCR inlet temperature, responsive to determining a difference between the SCR inlet temperature at SCR intake position and the target SCR inlet temperature, adjusting the SCR intake position to an adjusted SCR intake position such that a SCR inlet temperature at the adjusted SCR intake position is closer to or at the target SCR inlet temperature, comparing the SCR inlet temperature at the adjusted SCR intake position and the target SCR inlet temperature, and responsive to determining a difference between the SCR inlet temperature at the adjusted SCR intake position and the target SCR inlet temperature, adjusting an initial bypass valve position to an adjusted bypass valve position such that a SCR inlet temperature at the adjusted bypass valve position is closer to or at the target SCR inlet temperature.

An implementation relates to a system for an engine. The system can be configured to be communicated with a compressor. The system includes a conduit downstream of the compressor configured to deliver airflow to an intake manifold of the engine. The system includes a heat exchanger coupled to the conduit downstream of the compressor, the heat exchanger including a bypass conduit between an inlet of the heat exchanger and an outlet of the heat exchanger. The system includes a bypass valve coupled to the bypass conduit, the bypass valve configured to permit adjustment of airflow through the heat exchanger and the bypass conduit. The system includes an intake throttle valve coupled to the conduit downstream of the heat exchanger and coupled to the bypass conduit such that airflow from the bypass conduit is introduced to airflow exiting the outlet of the heat exchanger before entering the intake throttle valve, the intake throttle valve regulating airflow entering the engine. The system includes a selective catalytic reduction (SCR) system configured to receive sensor data comprising an SCR inlet temperature, responsive to the SCR inlet temperature being less than a target SCR inlet temperature, decrease airflow through the intake throttle valve to attain a first adjusted SCR inlet temperature closer to the target SCR inlet temperature, and responsive to the first adjusted SCR inlet temperature being less than the target SCR inlet temperature, increase airflow through the bypass valve to attain a second adjusted SCR inlet temperature closer to the target SCR inlet temperature.

An implementation relates to a controller for an internal combustion engine and exhaust system including a selective catalytic reduction (SCR) system. The controller includes at least one processor coupled to at least one memory device storing instructions that, when executed by the at least one processor, cause the controller to perform operations. The operations include receive, from one or more sensors, sensor data associated with engine operating conditions including selective catalytic reduction (SCR) inlet temperature, determine a first deviation based on a difference between the SCR inlet temperature and a target SCR inlet temperature, responsive to the first deviation exceeding an allowable deviation, adjust an intake throttle valve position by an amount based on the first deviation to control airflow through the throttle valve, determine a second deviation based on the adjusted intake throttle valve position and the difference between the SCR inlet temperature and the target SCR inlet temperature, and responsive to the second deviation exceeding the allowable deviation, adjust a bypass valve position by an amount based on the second deviation to control airflow through the bypass valve.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

BRIEF DESCRIPTION OF DRAWINGS

The foregoing and other features of the present disclosure will become more fully apparent from the following description and appended claims, taken in conjunction with the accompanying drawings. Understanding that these drawings depict only several implementations in accordance with the disclosure and are therefore, not to be considered limiting of its scope, the disclosure will be described with additional specificity and detail through use of the accompanying drawings.

Figure 1:
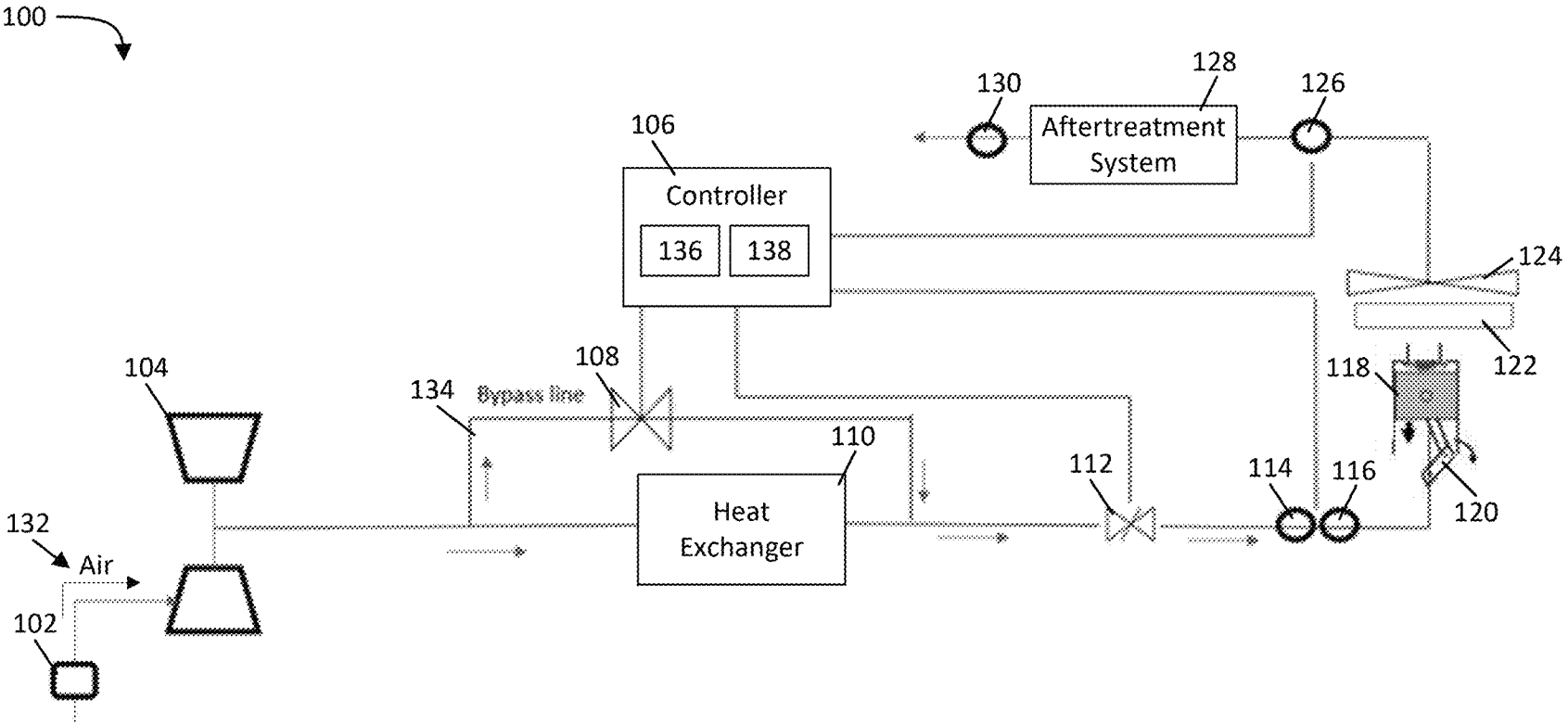
FIG. 1 is a schematic illustration of an exhaust system, according to an embodiment.

Reference is made to the accompanying drawings throughout the following detailed description. In the drawings, similar symbols typically identify similar components, unless context dictates otherwise. The illustrative implementations described in the detailed description, drawings, and claims are not meant to be limiting. Other implementations can be utilized, and other changes can be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

DETAILED DESCRIPTION

Referring to the Figures generally, the various embodiments disclosed herein relate generally to a system and method for controlling the exhaust temperature of an exhaust system. According to the present disclosure, the system includes an exhaust aftertreatment system which can include a selective catalytic reduction (SCR) system, an intake throttle valve, a bypass valve, and a controller. The controller is communicatively coupled to the exhaust throttle valve, the bypass valve, and the SCR system. The controller is structured to receive an inlet temperature of the selective catalytic reduction system, compare a SCR inlet temperature at an initial intake throttle valve position to a target SCR inlet temperature, and responsive to determining a difference between the SCR inlet temperature at SCR intake position and the target SCR inlet temperature, adjust the initial intake throttle valve position to an adjusted intake throttle valve position such that a SCR inlet temperature at the adjusted intake throttle valve position is closer to or at the target SCR inlet temperature if there is a difference between the SCR inlet temperature and the target SCR inlet temperature. In some embodiments, the controller may adjust the intake throttle valve position to decrease the difference between the SCR inlet temperature and target SCR inlet temperature. After the first comparison is made, the controller can be configured to compare the SCR inlet temperature at the adjusted SCR intake position and the target SCR inlet temperature and responsive to determining a difference between the SCR inlet temperature at the adjusted SCR intake position and the target SCR inlet temperature, adjust an initial bypass valve position to an adjusted bypass valve position such that a SCR inlet temperature at the adjusted bypass valve position is closer to or at the target SCR inlet temperature.

Various embodiments of the systems and methods described herein for increasing the exhaust temperature of an exhaust system can provide benefits that include, for example and without limitation, any one or more of (1) reducing the SCR system inefficiencies by ensuring that the SCR system is operating within a temperature range; (2) maintaining an intake manifold temperature above a dew point to avoid condensation; (3) increasing exhaust temperatures in cold operating conditions to aid the operation of the SCR system; or (4) cleaning the exhaust system, as may include use of waste heat to burn off accumulated soot (sometimes referred to as passive regeneration) or increasing fuel use to provide additional thermal energy to burn off the accumulated soot (sometimes referred to as active regeneration).

In some embodiments, an engine is equipped with an exhaust aftertreatment system which includes a selective catalytic reduction (SCR) configured to reduce the engine out NOx emissions. The efficient operation of the SCR can depend on the temperature within the aftertreatment system. For example, the SCR can provide conversion efficiency that satisfies one or more performance criteria within a target operating temperature range (e.g., 250° C.-400° C.) for its normal running operations, as well as the cleaning purpose. A controller can be coupled to the aftertreatment system and can be configured monitor the temperature of the aftertreatment system to ensure that the SCR is operating at the target operating temperature range. In some embodiments, the temperature of the SCR system can fall below the target operating temperature or operating temperature range. For example, in low temperature environments, the SCR temperature may not rise to the target operating range due to, for example, lower temperature air delivered to a combustion chamber.

Responsive to detecting that the SCR is not operating within the target operating range, the controller can control operation of one or more components associated with the engine (e.g., an intake throttle valve, a bypass valve, etc.) to cause an increase of the temperature of the air delivered to the SCR, and the SCR itself. For example, the controller can use a closed loop control system to maintain the temperature at an SCR inlet at a predetermined level (e.g., (~400° C.). More particularly, the controller can adjust the intake throttle valve to control the upstream air or control the opening degree of the bypass valve, thereby controlling the temperature of the SCR, and a moisture level, relative to a dew point. The controller can measure the temperature of the SCR using an SCR inlet temperature sensor, to verify that the exhaust temperature satisfies the cleaning purpose of the SCR (e.g., by comparing the temperature to a predefined threshold). In some embodiments, the controller adjusts at least one of the intake throttle valve or the bypass valve to a more closed position to reduce the air flow into the combustion chamber of the engine, as can increase the temperature of the exhaust air flowing into the aftertreatment system to increase the operating temperature of the aftertreatment system.

FIG. 1 shows a system 100 for an engine according to an example embodiment. In some embodiments, the system 100 can be a vehicle system. The vehicle can be an on-road or an off-road vehicle including, but not limited to, line-haul trucks, mid-range trucks (e.g., pick-up trucks), cars, boats, tanks, airplanes, locomotives, mining equipment, and any other type of vehicle that can utilize systems to reduce emissions. The vehicle can include a powertrain system, a fueling system, an operator input/output device, one or more additional vehicle subsystems, etc. The vehicle can include additional, fewer, or different components or systems, such that the principles, methods, systems, apparatuses, processes, and the like of the present disclosure are intended to be applicable with any other vehicle configuration. It should also be understood that the principles of the present disclosure should not be interpreted to be limited to vehicles; rather, the present disclosure is also applicable with stationary pieces of equipment such as a power generator or genset.

In brief overview, the system 100 can include an engine 118, a controller 106, a heat exchanger 110, a second heat exchanger 122, and an aftertreatment system 128. In some embodiments, the system 100 includes a pressure sensor 102 (sometimes referred to as a temperature based ambient pressure (TBAP) sensor 102 or a temperature based absolute pressure (TBAP) sensor 102), a compressor 104, an air conduit 132, an intake throttle valve 112, a bypass valve 108, a bypass conduit 134, an intake manifold temperature sensor 114, an intake manifold pressure sensor 116, an engine speed sensor 120, an engine fan 124, an SCR inlet temperature sensor 126, and an SCR outlet temperature sensor 130. In some embodiments, the bypass valve 108 is a change air cooler (CAC) bypass valve.

In some embodiments, the engine 118 is structured as a compression-ignition internal combustion (IC) engine that utilizes at least one fuel. Within the internal combustion engine 118, air from the atmosphere is combined with the fuel, and combusted to power the engine 118. Combustion of the fuel and air in the compression chambers of the engine 118 produces exhaust gas that is operatively vented to an exhaust manifold and to the aftertreatment system 128. The engine 118 can include an inline engine, V-type engine, flat engine, high-horsepower engine, or any other engine comprising one or more cylinders.

The air conduit 132 is structured to receive air into the combustion mixture of the system 100. The air conduit 132 can include an air inlet, an air filter, etc. The air received by the air inlet is received by the air filter. The air exits the air filter after having particulate matter substantially filtered from the air.

The compressor 104 is structured to compress (e.g., compress oxygen molecules together) air flowing into one or more cylinders of an internal combustion engine. In some embodiments, the compressor 104 can be included in a turbocharger, supercharger, or so forth. The compressor 104 can include an impeller (e.g., a compressor wheel) which can be driven or otherwise actuated via a turbine or other drive. As the impeller turns, air is received or otherwise driven into the impeller to convert the air into a high-pressure, low-velocity air stream according to a diffusion process. The air (e.g., the compressed air) is driven, via the intake manifold, into the engine. Advantageously, the compressed air enables the engine to burn more fuel and generate more power for a given fuel-air ratio.

In some embodiments, the compressed air from the compressor 104 is provided to the heat exchanger 110. The heat exchanger 110, such as a charge air cooler or an intercooler, can be used to cool the compressed air before the air enters the cylinders. The heat exchanger 110 can be any type of heat exchanger 110 including but not limited to a parallel flow heat exchanger 110, a counter-flow heat exchanger 110, or a crossflow heat exchanger 110. In some embodiments, the compressed air from the compressor 104 can flow through the bypass conduit 134 instead of through the heat exchanger 110. A bypass valve 108 can fluidly couple the bypass conduit 134 and selectively adjust a flowrate of the portion of the compressed air flowing through the bypass conduit 134. The bypass valve 108 can adjust the proportion of the air flow passing through the intercooler and the bypass pipeline. Bypass valve adjustments can control a temperature of an intake manifold to maintain a temperature above a dew point, as may prevent condensation and resulting corrosion. The intake throttle valve 112 can be configured to control the flow of compressed air into the engine 118.

Various sensors, such as pressure sensors, temperature sensors, speed sensors, etc. can be strategically disposed throughout the system 100 and can be in communication with the controller 106 to monitor operating conditions of the system 100. In this regard, the controller 106 can receive data from the one or more sensors. Moreover, the controller 106 can determine additional data (e.g., temperatures, pressures, speeds, and so forth) based on received sensor data. For example, a temperature of an exhaust can be predicted based on an inlet temperature and a rate of combustion of an engine.

As shown in FIG. 1, the system 100 includes the TBAP sensor 102, the intake manifold temperature sensor 114, the intake manifold pressure sensor 116, the engine speed sensor 120, the SCR inlet temperature sensor 126, and the SCR outlet temperature sensor 130. The TBAP sensor 102 is positioned proximate to the air conduit 132 and is configured to measure the temperature of the air flowing into the air compressor 104. The intake manifold temperature sensor 114 is positioned downstream of the intake throttle valve 112 and is configured to measure the temperature of the compressed air flowing into the engine 118. The intake manifold pressure sensor 116 is also positioned downstream of the intake throttle valve 112 and is configured to measure the pressure in the intake manifold. The engine speed sensor 120 can be configured to measure the speed of the engine 118. The SCR inlet temperature sensor 126 is positioned proximate to the inlet of the aftertreatment system 128 and is configured to measure the inlet temperature of the aftertreatment system. The SCR inlet temperature sensor 126 is positioned proximate to the outlet of the aftertreatment system 128 and is configured to measure the outlet temperature of the aftertreatment system 128.

Exhaust air from the engine 118 can flow into the second heat exchanger 122 and through the fan 124. The fan 124 is rotated to create a fluid (e.g., air, etc.) flow across the engine 118. This fluid flow facilitates cooling of the engine 118.

The exhaust air from the engine flows into the aftertreatment system 128. The aftertreatment system 128 is structured to reduce emission of particulate matter, nitrogen oxides (NOx), hydrocarbons, and other pollutants. In some embodiments, the aftertreatment system 128 includes a diesel particulate filter (DPF), a diesel oxidation catalyst (DOC), a selective catalytic reduction (SCR) system with a SCR catalyst, and an ammonia oxidation (AMOx) catalyst. The aftertreatment system 128 receives the exhaust gas via at least one of an exhaust manifold, an exhaust throttle valve, a wastegate valve, or turbine. After undergoing treatment, the exhaust gas flows or otherwise exits the aftertreatment system 128.

The controller 106 is coupled with the systems/components of the system 100 and can at least partly control the operation of the system 100, and an associated vehicle. The controller 106 can cause various of the adjustment provided herein, according to a generation and transmission of control signals. For example, the control signals can cause the adjusts to the throttle valve position and the bypass valve position referred to throughout the present disclosure. The controller 106 can implement the methods described in FIG. 2 below. Specifically, the controller 106 can be communicably coupled with one or more sensors within the system 100 to receive sensor data from the one or more sensors. For example, the controller 106 can receive temperature sensor data indicating the temperature in different parts of the system from the TBAP sensor 102, the intake manifold temperature sensor 114, the SCR inlet temperature sensor 126, and the SCR outlet temperature sensor 130. Based on the temperature sensor data, the controller 106 can determine whether a temperature value associated with the aftertreatment system 128 is above a predetermined level (e.g., 400° C.).

The controller 106 can control the intake throttle valve 112 or the bypass valve 108 to adjust the temperature of the SCR within the aftertreatment system 128. For example, responsive to determining that the temperature value associated with the aftertreatment system 128 is not above the predetermined threshold, the controller 106 can generate and transmit control signals to raise the temperature of the SCR. The controller can adjust the intake throttle valve 112 or the bypass valve 108 iteratively, to continue to optimize their position until detecting a target SCR inlet temperature (or deviation within the range). In some embodiments, closing the intake throttle valve 112 reduces the air flow going to a combustion chamber of the engine 118 and cause a subsequent increase in the exhaust temperature. Subsequent to a first adjustment (e.g., iteratively), the controller 106 can receive an intake manifold temperature measurement from the intake manifold temperature sensor 114 and maintain the intake manifold temperature above dew point temperature by adjusting the bypass valve 108 to achieve a target intake manifold temperature. For example, the controller can implement a closed control algorithm to manage the position of the intake throttle valve 112 or the bypass valve 108, among other components. Such adjustments can control an SCR temperature, as may correspond to a range for passive or active regeneration, while maintaining a temperature of an intake manifold above a dew point, to prevent condensation or corrosion.

In some embodiments, the controller 106 can use the closed loop algorithmic control system to maintain the temperature at SCR inlet at a predetermined level, such as within a range, (e.g., (~400° C.) by adjusting the opening of intake throttle valve 112 and the bypass valve 108 to control the temperature of the SCR within the aftertreatment system 128. Such a temperature can be detected by the controller 106, such that the controller 106 can determine that the exhaust temperature satisfies the cleaning operation of the SCR. For example, the controller 106 can receive a temperature as measured by the SCR inlet temperature sensor 126 and compare the received temperature to a threshold.

In some embodiments, the controller 106 adjusts the intake throttle valve 112 or the bypass valve 108 (e.g., using the control signals) to a more closed position which reduces the air flow into the combustion chamber of the engine 118 to increase the temperature of the exhaust air flowing into the aftertreatment system 128, thereby increasing the operating temperature of the aftertreatment system 128. In some embodiments, the controller 106 can a proportional-integral-derivative (PID) control loop for the closed loop algorithmic control for controlling the temperature within the SCR. In these embodiments, the controller 106 can continuously calculate the difference between the SCR inlet target temperature and the actual SCR inlet temperature. The difference calculated by the controller 106 can be used as feedback into the PID control loop to determine control signals to lower the difference between the actual SCR inlet temperature and the target SCR inlet temperature. The control signals can be based on proportional, integral, and derivative terms.

The controller 106 can include one or more processors 136 and a memory 138. The processor 136 can include a microprocessor, an application-specific integrated circuit (ASIC), a field-programmable gate array (FPGA), etc., or combinations thereof. The memory 138 can include, but is not limited to, electronic, optical, magnetic, or any other storage or transmission device capable of providing a processor, ASIC, FPGA, etc., with program instructions. The memory 138 can include a memory chip, Electrically Erasable Programmable Read-Only Memory (EEPROM), Erasable Programmable Read Only Memory (EPROM), flash memory, or any other suitable non-transitive memory from which the controller 106 can read instructions. The instructions can include code from any suitable programming language. The memory 138 can include various modules that include instructions which are configured to be executed or otherwise implemented by the processor 136. Although an example processor 136 and memory 138 of controller 106 have been described with respect to FIG. 1, the subject matter including the operations described in this specification can be implemented in other types of digital electronic circuitry, or in computer software, firmware, or hardware, including the structures disclosed in this specification and their structural equivalents, or in combinations of one or more of them. The processor 136 or memory 138 can be implemented as hardware for performing operations other than control operations, including but not limited to any of various data storage, communication, or processing operations.

The controller 106 can be at least partially implemented by or can be communicably coupled with any of various control hardware (not shown) associated with operation of the system 100, including but not limited to an engine control unit (ECU) or engine control module (ECM). In some embodiments, the controller 106 can receive or detect one or more signals, such as electrical signals or electronic signals, regarding operation of the system 100 (sometimes referred to as a temperature value, pressure value, or other sensor data, such as ambient pressure data). As indicated above, the controller 106 can cause an actuation of system components according to generation and transmission of control signals. For example, the controller 106 can actuate the bypass valve 108 or the intake throttle valve 112 when the temperature of the aftertreatment system is above or below a certain threshold by generating and transmitting a control signal.

In some embodiments, the controller 106 includes least one processor coupled to at least one memory device storing instructions that, when executed by the at least one processor, cause the controller to perform operations. The operations can include receiving, from one or more sensors, sensor data associated with engine operating conditions including selective catalytic reduction (SCR) inlet temperature. The operations can include determining a first deviation based on a difference between the SCR inlet temperature and a target SCR inlet temperature. The operations can include, responsive to the first deviation exceeding an allowable deviation, adjusting an intake throttle valve position by an amount based on the first deviation to control airflow through the throttle valve.

The operations can include determining a second deviation based on the adjusted intake throttle valve position and the difference between the SCR inlet temperature and the target SCR inlet temperature. The operations can include, responsive to the second deviation exceeding the allowable deviation, adjusting a bypass valve position by an amount based on the second deviation to control airflow through the bypass valve. The operations can include determining, based on an SCR conversion efficiency, the target SCR inlet temperature to maintain a target temperature zone for normal operation. In some embodiments, the operations can include monitoring whether an intake manifold temperature falls below a dew point temperature, and responsive to the intake manifold temperature falling below the dew point temperature, performing control to adjust the bypass valve position by an amount based on a difference between the intake manifold temperature and the dew point.

In some embodiments, the controller 106 is configured to obtain a target SCR inlet temperature from a look-up table and wherein the target SCR inlet temperature is predetermined to satisfy a passive cleaning criterion of the SCR system. In some embodiments, determining the first deviation based on a difference between the SCR inlet temperature and a target SCR inlet temperature is responsive to detecting a cold start or a light load operation.

Although not shown in FIG. 1, the system 100 can include sensors such as, for example, temperature sensors, pressure sensors, NOx sensors, oxygen sensors, ammonia sensors or any other sensors. The controller 106 can be communicatively coupled to one or more such sensors to receive and interpret signals, information, or data from one or more of these sensors. The controller 106 can use the information from one or more of these sensors to carry out the functions as described herein. In some embodiments, the sensor data further includes an intake manifold temperature, and the controller is further configured to, responsive to the intake manifold temperature being below a dew point temperature, actuate the bypass valve to increase airflow through the bypass valve to increase the intake manifold temperature. In some embodiments, the sensor data further includes ambient temperature and ambient pressure from a temperature based ambient pressure (TBAP) sensor 102 disposed upstream of the compressor 104. In some embodiments, the sensor data further includes at least one of engine rotation speed data, temperature variation data of airflow entering the SCR, pressure data of airflow entering the engine, temperature data of airflow entering the engine, pressure data of airflow exiting the compressor, or temperature data of airflow exiting the compressor 104.

Referring further to FIG. 1, the system 100 can include the air conduit 132 downstream of the compressor 104 configured to deliver airflow to an intake manifold of the engine 118. The system 100 can include the heat exchanger 110 coupled to the air conduit 132 downstream of the compressor 104, the heat exchanger 110 including the bypass conduit 134 between an inlet of the heat exchanger 110 and an outlet of the heat exchanger 110. The system 100 includes the bypass valve 108 coupled to the bypass conduit 134, the bypass valve 108 configured to permit adjustment of airflow through the heat exchanger 110 and the bypass conduit 134. The system 100 can include the intake throttle valve 112 coupled to the conduit downstream of the heat exchanger 110 and coupled to the bypass conduit 134 such that airflow from the bypass conduit 134 is introduced to airflow exiting the outlet of the heat exchanger 110 before entering the intake throttle valve 112, the intake throttle valve 112 regulating airflow entering the engine 118. The system 100 can include a selective catalytic reduction (SCR) system 140 configured to receive exhaust gas produced by the engine through an SCR inlet.

The controller 106 can receive sensor data comprising an SCR inlet temperature. The controller 106 can, responsive to the SCR inlet temperature being less than a target SCR inlet temperature, decrease airflow through the intake throttle valve to attain a first adjusted SCR inlet temperature closer to the target SCR inlet temperature. The controller 106 can, responsive to the first adjusted SCR inlet temperature being less than the target SCR inlet temperature, increase airflow through the bypass valve to attain a second adjusted SCR inlet temperature closer to the target SCR inlet temperature. Therefore, the system 100 can increase the operating temperature of the aftertreatment system 128 to meet a target operating temperature. Ensuring that the system 100 operates within a target operating temperatures can improve the cleaning of the aftertreatment system 128.

Figure 2:
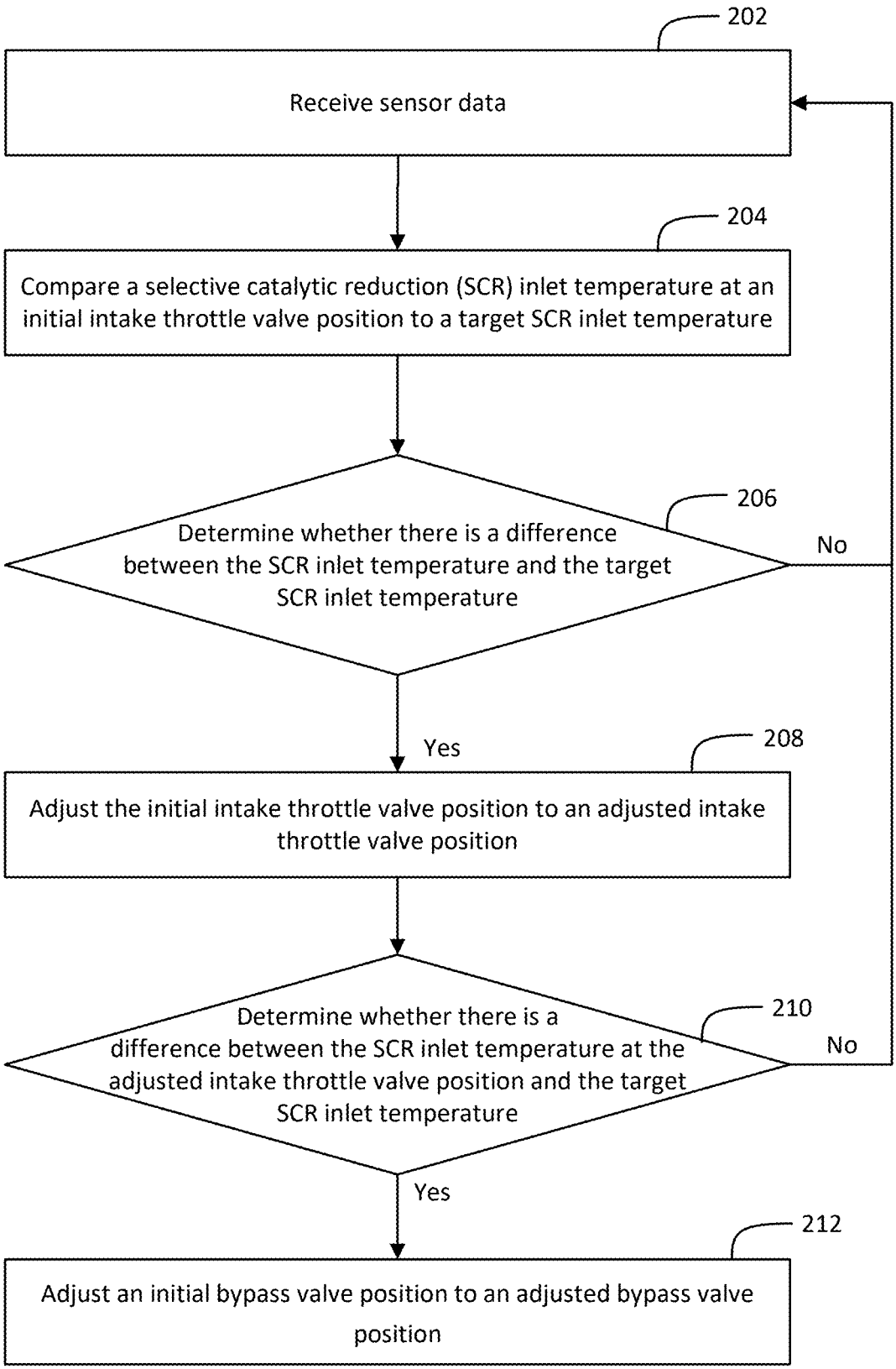
FIG. 2 is a schematic diagram of a flowchart of a method for controlling the temperature of an exhaust system, according to an example embodiment.

Referring now to FIG. 2, a method 200 for controlling an internal combustion engine and an aftertreatment system including a selective catalytic reduction (SCR) system is shown, according to an embodiment. For example, the present method can be performed according to the controller 106 of FIG. 1, coupled with other components of the depicted system 100, executing instructions to cause the components to execute the present method 200.

At operation 202, the controller 106 receives sensor data including an SCR inlet temperature from one or more of the TBAP sensor 102, the intake manifold temperature sensor 114, the intake manifold pressure sensor 116, the engine speed sensor 120, the SCR inlet temperature sensor 126, and the SCR outlet temperature sensor 130. In some embodiments, the sensor data can include data that indicates the temperature at different places within the system 100. In some embodiments, the controller 106 can detect that an ambient temperature of the SCR system is about −30 degrees Celsius to about 45 degrees Celsius prior to comparing the SCR inlet temperature (e.g., at an initial intake throttle valve position) to the target SCR inlet temperature. For example, the controller can compare the SCR inlet temperature at the intake throttle valve position to the target SCR inlet temperature based on the detection of the temperature as between about −30 degrees Celsius to about 45 degrees Celsius, or perform subsequent operations responsive to the detection of the temperature as between about −30 degrees Celsius to about 45 degrees Celsius. The ambient temperature can be determined based on sensor data from the TBAP sensor 102, among others.

At operation 204, the controller 106 can compare the SCR inlet temperature at an SCR intake position to a target SCR inlet temperature. In some embodiments, the SCR inlet temperature is received by the controller 106 by the SCR inlet temperature sensor 126. The target SCR inlet temperature can be predetermined and set at a temperature where the aftertreatment system 128 converts NOx into nitrogen gas ($N_2$) and water vapor ($H_2O$) in the presence of ammonia ($NH_3$) at a sufficiently efficiency level. In some embodiments, the controller 106 can activate an SCR cleaning mode prior to comparing the SCR inlet temperature at the intake throttle valve position to the target SCR inlet temperature. Such a mode can refer to either of an active or a passive mode, as may further be based on a detected pressure differential across a soot buildup, soot load estimation according to a soot mass model, timer, or exhaust gas sensors.

At operation 206, the controller 106 determines whether there is a difference between the SCR inlet temperature and the target SCR inlet temperature. In some embodiments, the controller 106 can determine a target deviation between the current SCR inlet temperature and the target SCR inlet temperature. The controller 106 can determine whether a difference between the current SCR inlet temperature and the target SCR inlet temperature is within the target deviation. The controller 106 can determine that the current SCR inlet temperature is at the target SCR inlet temperature responsive to the difference between the current SCR inlet temperature and the target SCR inlet temperature being within the target deviation. For example, determining the target deviation between the current SCR inlet temperature and the target SCR inlet temperature includes determining that the difference between the current SCR inlet temperature and the target SCR temperature is about 10 to about 20 degrees Celsius. If there is no difference between the SCR inlet temperature and the target SCR inlet temperature, the method can proceed to operation 202 to continue to receive and monitor sensor data. If there is a difference between the SCR inlet temperature and the target SCR inlet temperature (e.g., a difference exceeding the target deviation), the method can proceed to operation 208.

At operation 208, the controller 106 adjusts the SCR intake position to an adjusted SCR intake position responsive to determining a difference between the SCR inlet temperature at the SCR intake position and the target SCR inlet temperature. In some embodiments, the SCR intake position is adjusted such that a SCR inlet temperature at the adjusted SCR intake position is closer to or at the target SCR inlet temperature (e.g., within a deviation threshold). In some embodiments, the controller 106 adjusts the position of the intake throttle valve 112 by sending a control signal to the intake throttle valve 112 to move towards a more closed position. Adjusting the intake throttle valve 112 to a more closed position can cause a reduction to the air flow into the combustion chamber of the engine 118 which increases the temperature of the exhaust air flowing into the aftertreatment system 128, thereby increasing the operating temperature of the aftertreatment system 128. In some embodiments, adjusting the bypass valve position causes the target SCR inlet temperature to be about 380 to about 420 degrees Celsius. In some embodiments, adjusting the SCR intake position includes adjusting the SCR intake position to the adjusted intake throttle valve position within an intake throttle valve limit.

At operation 210, the controller 106 compares the SCR inlet temperature at the adjusted intake throttle valve position and the target SCR inlet temperature to determine whether there is a difference between the SCR inlet temperature at the adjusted intake throttle valve position and the target SCR inlet temperature. If there is no difference between the SCR inlet temperature at the adjusted intake throttle valve position and the target SCR inlet temperature (or the difference is less than a deviation threshold), the method proceeds to operation 202 to continue to receive and monitor sensor data. If there is a difference between the SCR inlet temperature at the adjusted intake throttle valve position and the target SCR inlet temperature, the method proceeds to operation 212.

At operation 212, the controller 106 adjusts the bypass valve position to an adjusted bypass valve position responsive to determining a difference between the SCR inlet temperature at the adjusted intake throttle valve position and the target SCR inlet temperature. In some embodiments, the controller 106 adjusts the position of the bypass valve 108 by sending a control signal to the bypass valve 108 to move towards a more closed position. Adjusting the bypass valve 108 to a more closed position can reduce the air flow into the combustion chamber of the engine 118 which increases the temperature of the exhaust air flowing into the aftertreatment system 128, thereby increasing the operating temperature of the aftertreatment system 128. In some embodiments, adjusting the bypass valve position includes adjusting the bypass valve position to the adjusted bypass valve position within a bypass valve limit.

In some embodiments, the method 200 can further include determining, by the controller 106. whether an intake manifold temperature is above a dew point temperature. Responsive to determining that the intake manifold temperature is less than the dew point temperature, the controller 106 can adjust the bypass valve position within the bypass valve opening limit.

The schematic flow chart diagrams and method schematic diagrams described above are generally set forth as logical flow chart diagrams. As such, the depicted order and labeled steps are indicative of representative embodiments. Other steps, orderings and methods can be conceived that are equivalent in function, logic, or effect to one or more steps, or portions thereof, of the methods illustrated in the schematic diagrams.

The various concepts described above can be implemented in any of numerous ways, as the described concepts are not limited to any particular manner of implementation. Examples of specific implementations and applications are provided primarily for illustrative purposes.

Various numerical values herein are provided for reference purposes only. Unless otherwise indicated, all numbers expressing quantities of properties, parameters, conditions, and so forth, used in the specification and claims are to be understood as being modified in all instances by the term "approximately." Accordingly, unless indicated to the contrary, the numerical parameters set forth in the following specification and attached claims are approximations. Any numerical parameter should at least be construed in light of the number reported significant digits and by applying ordinary rounding techniques. The term "approximately" when used before a numerical designation, e.g., a quantity or an amount including range, indicates approximations which can vary by (+) or (−) 10%, 5%, or 1%.

As will be understood by one of skill in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member.

It should be noted that the term "example" as used herein to describe various embodiments is intended to indicate that such embodiments are possible examples, representations, or illustrations of possible embodiments (and such term is not intended to connote that such embodiments are necessarily extraordinary or superlative examples).

As utilized herein, the term "substantially" and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

The term "coupled" and variations thereof, as used herein, means the joining of two members directly or indirectly to one another. Such joining can be stationary (e.g., permanent or fixed) or moveable (e.g., removable or releasable). Such joining can be achieved with the two members coupled directly to each other, with the two members coupled with each other using one or more separate intervening members, or with the two members coupled with each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling can be mechanical, electrical, or fluidic. For example, circuit A communicably "coupled" to circuit B can signify that the circuit A communicates directly with circuit B (i.e., no intermediary) or communicates indirectly with circuit B (e.g., through one or more intermediaries).

References herein to the positions of elements (e.g., "top," "bottom," "above," "below") are merely used to describe the orientation of various elements in the FIGURES. It should be noted that the orientation of various elements can differ according to other exemplary embodiments, and that such variations are intended to be encompassed by the present disclosure. The term "or," as used herein, is used in its inclusive sense (and not in its exclusive sense) so that when used to connect a list of elements, the term "or" means one, some, or all of the elements in the list.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

It is important to note that the construction and arrangement of the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, orientations, etc.) without materially departing from the novel teachings and advantages of the subject matter described herein. Other substitutions, modifications, changes and omissions can also be made in the design, operating conditions and arrangement of the various exemplary embodiments without departing from the scope of the embodiments described herein.

While this specification contains specific implementation details, these should not be construed as limitations on the scope of any embodiment or of what can be claimed, but rather as descriptions of features specific to particular implementations of particular embodiments. Certain features described in this specification in the context of separate implementations can also be implemented in combination in a single implementation. Conversely, various features described in the context of a single implementation can also be implemented in multiple implementations separately or in any suitable subcombination. Moreover, although features can be described above as acting in certain combinations and even initially claimed as such, one or more features from a claimed combination can in some cases be excised from the combination, and the claimed combination can be directed to a subcombination or variation of a subcombination.

What is claimed is:

1. A method of controlling an internal combustion engine and an aftertreatment system including a selective catalytic reduction (SCR) system, the method comprising:

adjusting a first SCR intake condition to a second SCR intake condition to reduce a first difference between an SCR inlet temperature at the first SCR intake condition and a target SCR inlet temperature using an intake throttle valve to an adjusted intake throttle valve position, responsive to the determination of the first difference; and adjusting a bypass valve position to reduce a second difference between the SCR inlet temperature at the second SCR intake condition and the target SCR inlet temperature, responsive to determining the second difference.

2. The method of claim 1, further comprising:

determining whether an intake manifold temperature is above a dew point temperature; and adjusting the bypass valve position within a bypass valve opening limit responsive to determining that the intake manifold temperature is less than the dew point temperature.

3. The method of claim 1, further comprising:

determining a target deviation between the SCR inlet temperature and the target SCR inlet temperature; and determining that the SCR inlet temperature is at the target SCR inlet temperature responsive to determining that a difference between the SCR inlet temperature and the target SCR inlet temperature is within the target deviation.

4. The method of claim 3, wherein determining the target deviation comprises determining that the difference between the SCR inlet temperature and the target SCR inlet temperature is between 10 and 20 degrees Celsius.

5. The method of claim 1, further comprising:

adjusting the first SCR intake condition based on a detection of an ambient temperature of the SCR system of between −30 to 45 degrees Celsius.

6. The method of claim 1, further comprising:

activating an SCR cleaning mode prior to comparing the SCR inlet temperature at the first SCR intake condition to the target SCR inlet temperature.

7. The method of claim 1, wherein adjusting the bypass valve position causes the target SCR inlet temperature to be between 380 to 420 degrees Celsius.

8. The method of claim 1, wherein adjusting the first SCR intake condition comprises adjusting the intake throttle valve to the adjusted intake throttle valve position within an intake throttle valve limit.

9. The method of claim 1, wherein adjusting the bypass valve position comprises adjusting the bypass valve position within a bypass valve limit.

10. A system for an engine, the system configured to communicate with a compressor, the system comprising:

a conduit downstream of the compressor configured to deliver airflow to an intake manifold of the engine;

a heat exchanger coupled to the conduit, the heat exchanger including a bypass conduit between an inlet of the heat exchanger and an outlet of the heat exchanger;

a bypass valve coupled to the bypass conduit, the bypass valve configured to permit adjustment of airflow through the heat exchanger and the bypass conduit;

an intake throttle valve coupled to the conduit downstream of the heat exchanger and coupled to the bypass conduit such that airflow from the bypass conduit is introduced to airflow exiting the outlet of the heat exchanger before entering the intake throttle valve, the intake throttle valve regulating airflow entering the engine;

a selective catalytic reduction (SCR) system configured to receive exhaust gas produced by the engine through an SCR inlet; and a controller configured to:

receive sensor data comprising an SCR inlet temperature, generate control signals to decrease airflow through the intake throttle valve to reduce a difference between the SCR inlet temperature and a target SCR inlet temperature responsive to the SCR inlet temperature being less than the target SCR inlet temperature, and generate control signals to increase airflow through the bypass valve to reduce a difference between the SCR inlet temperature and the target SCR inlet temperature responsive to the SCR inlet temperature being greater than the target SCR inlet temperature.

11. The system of claim 10, wherein the sensor data further comprises an intake manifold temperature, and the controller is further configured to:

generate control signals to increase airflow through the bypass valve to increase the intake manifold temperature responsive to the intake manifold temperature being below a dew point temperature.

12. The system of claim 11, wherein the controller is further configured to:

determine the dew point using ambient temperature and ambient pressure data, wherein the sensor data includes the ambient temperature and ambient pressure data from a temperature based ambient pressure (TBAP) sensor disposed upstream of the compressor.

13. The system of claim 10, wherein the controller is further configured to control the SCR system based on sensor data comprising at least one of engine rotation speed data, temperature variation data of airflow entering the SCR system, pressure data of airflow entering the engine, temperature data of airflow entering the engine, pressure data of airflow exiting the compressor, or temperature data of airflow exiting the compressor.

14. The system of claim 10, wherein the controller is configured to:

compare a deviation between the SCR inlet temperature and the target SCR inlet temperature to a target deviation; and generate the control signals to increase or decrease the airflow responsive to a comparison of the deviation to the target deviation.

15. The system of claim 14, wherein the target deviation exceeds 10 degrees Celsius.

16. A controller for an internal combustion engine and exhaust system including a selective catalytic reduction (SCR) system, the controller comprising at least one processor coupled to at least one memory device storing instructions configured to, when executed by the at least one processor, cause the controller to:

receive, from one or more sensors, sensor data associated with engine operating conditions including selective catalytic reduction (SCR) inlet temperature;

determine a first deviation based on a difference between the SCR inlet temperature and a target SCR inlet temperature;

adjust an intake throttle valve position based on the first deviation to control airflow through the throttle valve responsive to the first deviation exceeding an allowable deviation;

determine a second deviation based on the adjusted intake throttle valve position and the difference between the SCR inlet temperature and the target SCR inlet temperature; and adjust a bypass valve position based on the second deviation to control airflow through the bypass valve responsive to a determination that the second deviation exceeds the allowable deviation.

17. The controller of claim 16, wherein the instructions include instructions to:

obtain the target SCR inlet temperature from a look-up table using the sensor data associated with the engine operating conditions, wherein the target SCR inlet temperature satisfies a passive cleaning criterion of the SCR system.

18. The controller of claim 16, wherein the instructions include instructions to:

determine, based on an SCR conversion efficiency, the target SCR inlet temperature to maintain a target temperature zone for normal operation.

19. The controller of claim 16, wherein the instructions include instructions to:

detect an intake manifold temperature below a dew point temperature; and generate a control signal to adjust the bypass valve position responsive to the detection, wherein an amount of the adjustment is based on a difference between the intake manifold temperature and the dew point.

20. The controller of claim 16, wherein the instructions include instructions to:

detect a condition of a cold start or a light load; and determine the first deviation based on a difference between the SCR inlet temperature and a target SCR inlet temperature responsive to the detection of the condition.

* * * * *